United States Patent [19]

Apuzzo

[11] 4,392,800

[45] Jul. 12, 1983

[54] PRESS FOR PULVERULENT MATERIALS

[75] Inventor: Gennaro Apuzzo, Napoli, Italy

[73] Assignee: Merisinter S.p.A., Arzano, Italy

[21] Appl. No.: 230,586

[22] Filed: Feb. 2, 1981

Related U.S. Application Data

[63] Continuation of Ser. No. 150,574, May 16, 1980, abandoned, which is a continuation of Ser. No. 35,470, Apr. 25, 1979, abandoned.

[30] Foreign Application Priority Data

Jul. 24, 1978 [IT] Italy ..... 50446 A/78

[51] Int. Cl.[3] ..... B30B 11/02

[52] U.S. Cl. ..... 425/78; 425/352; 425/156; 425/162; 425/165; 425/167; 425/214; 425/355; 425/411

[58] Field of Search ..... 425/78, 155, 156, 162, 425/165, 167, 214, 352, 355, 406, 411

[56] References Cited

U.S. PATENT DOCUMENTS

| | | | |
|---|---|---|---|
| 2,325,687 | 8/1943 | Kux | 425/355 |
| 2,509,783 | 5/1950 | Richardson | 425/78 |
| 3,191,232 | 6/1965 | Haller | 425/78 |
| 3,611,498 | 10/1971 | Hedin | 425/78 |
| 3,758,245 | 9/1973 | Hermes | 425/78 |
| 3,802,818 | 4/1974 | Watanabe et al. | 425/355 X |
| 3,868,201 | 2/1975 | Jacobson et al. | 425/167 X |
| 4,128,376 | 12/1978 | Abertazzi | 425/411 X |

*Primary Examiner*—J. Howard Flint, Jr.
*Attorney, Agent, or Firm*—Michael J. Striker

[57] ABSTRACT

A press for compressing pulverulent materials into both concave and convex pieces includes a press frame, a die carying plate, upper and lower punches, holders for carrying the punches and control devices for controlling the displacement of the upper and lower punches. The press comprises also a first piston-cylinder device for controlling the displacement of the die carrying plate, a second piston-cylinder device fastened to the frame and supporting the die carrying plate, levers arranged above the die carrying plate and having one end pivoted to the frame and sliders slidable on the opposite ends are provided in the press. The first piston cylinder device acts on the other ends of the levers to exert thereon a pressure depending on the distance of the sliders from the other ends of the levers.

4 Claims, 12 Drawing Figures

PRESS FOR PULVERULENT MATERIALS

This is a continuation, of application Ser. No. 150,574, filed May 16, 1980 now abandoned which in turn is a continuation of application Ser. No. 035,470, filed Apr. 25, 1979 and now abandoned.

BACKGROUND OF THE INVENTION

The present invention relates to a press for purvulent materials, and particularly to a press for compacting convex or concave articles from metal powder.

As it is well known to the experts of this art all presses for powder compaction existing to-day and the relative dies do not allow for a control and adjustment of the movement of the die elements and the relative reactions to such a movement of same elements during the displacement from one position to another; thereby, it follows that not all the details realizable in theory in their shape with the powder metallurgy technique, with a press of fixed capacity, can in practice be produced and without defects on such a press, insomuch as they require the use of a press endowed with a much greater capacity or even to have recourse to the expedient of producing a rough-shaped piece wherefrom through subsequent mechanical workings the final shape of the detail can be attained.

For example, for compacting an article having a shape different (f.e. concave) from that previously compacted (f.e. convex), it is necessary, in the known presses to radically modify the assemblage type of the press or to change the press itself.

A typical known press arrangement is shown in FIGS. 1 and 2A, 2B and 2C of the drawings. Such a press consists of a hollow die, at least one lower punch P, at least one core A and at least one upper punch S, as shown in FIG. 1. The lower punches P and the core A define the cavity to be filled with a pulverulent material as shown in FIG. 2A, whereas the upper punches S cooperate with the lower ones for compacting the powder and obtaining the finished article.

Generally a semifinished product is firstly produced in a known press as shown in FIG. 3B and then finished by a mechanical removal of the parts T as shown in FIG. 3C.

Likely, when it is necessary to pass from the production of a convex piece as shown in FIG. 4A to the production of a concave piece according to FIG. 4B, the die and punch arrangement must be radically modified or press type must be changed.

Moreover, the presses known up to-day do not provide means apt to control and adjust both the movement of the punches and cores and respective reaction to said movement during the displacement from one to another position thereof. Therefore, as already said, articles having some particular shapes can not be manufactured with the known presses, without the necessity to finish the rough product by a mechanical working.

SUMMARY OF THE INVENTION

An object of the present invention is that to provide a press which avoids the above disadvantage and allows to obtain an exactly finished product which may have a substantially concave or convex shape without any mechanical working step.

The object of the present invention is that of realizing a press and relative die holder which allow:

(a) control and adjustment of the movement of the elements constituting the die during the compression phase;

(b) control and adjustment of the movement of the elements constituting the die during the extraction phase of the piece formed by the cavity of the die;

(c) control and adjustment of the movement of the elements of the die during the return phase to filling position;

(d) production of all the shapes and dimensions theoretically realizable by means of the powder metallurgical technology with the single limitation of the nominal capacity of the press;

(e) production by means of the same plant of details indifferently of an essentially convex or essentially concave shape without radical and expensive modifications of the type of die assemblage;

(f) reduction of the equipment and assemblage times.

The objects of the present invention are attained by a press having a frame, a die carrying plate, upper and lower punches, support means for carrying said upper and lower punches and control means for controlling the displacement of said upper and lower punches, which press includes also first piston and cylinder means for controlling the displacement of said die carrying plate, second piston and cylinder means fastened to said frame and supporting said die plate, lever means arranged above said die plate and having one end pivoted to said frame, slider means slidably arranged on the opposite end portion of said lever means and abutting on said die plate. Said first piston and cylinder means act on the other end of said lever means to exert thereon a pressure depending on the distance of said slider means from said other end of said lever means. Support means are provided for each of said lower punches, said support means being controlled by piston and cylinder means fastened to said frame. The displacement range of said die plate and first support means are limited by adjustable stop elements. Said upper punches are supported by support means which include control means for controlling the displacement of said upper punches.

A movable core is arranged within the concentrical upper and lower punches and is supported by a core rod carried by support means arranged on the lower end of the rod. The displacement of the core rod support means is controlled by piston and cylinder means and adjustable stop elements being provided to limit the displacement range of said core rod.

The present invention envisages a press which can be either of the hydraulic or the mechanical type, having essentially three movements:

(1) Control movement of the upper group (head)

(2) Control movement of the lower group (extraction)

(3) Control movement of the powder charging hopper.

This press allows for the utilization of a die functioning on the principle of the floating matrix (known of itself), a principle which implies a correlative movement between matrix and lower punches by means of the descent of said matrix during the compaction phase of the powder, and by means of the ascent of the lower punches during the extraction phase of the piece formed.

Said P the nominal capacity of the press expressed in tons, the force available for the control movement of the lower group (extraction) will be in the range of $0.2 \div 0.6$. P.

The present invention will now be described with reference to the attached drawings, which represent an illustrative but not limitative preferred embodiment of the present invention itself.

DETAILED DESCRIPTION OF THE PREFERRED EMBODIMENTS

Figure 1:
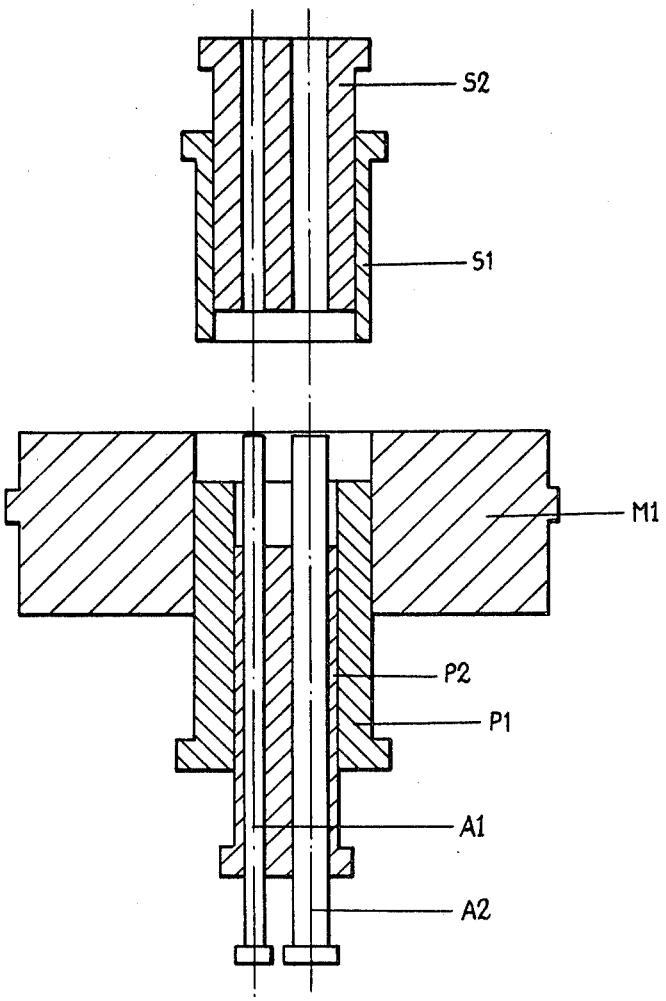
FIG. 1 represents a schematical sectional view of a die of the known type.

With reference to the FIG. 1, the die is generally constituted by a hollow matrix, having a prismatic pattern, having one or more section M1, by one or more lower punches P1, P2, by one or more cores A1 and A2, by one or more upper punches S1 and S2.

These elements, assembled on a die holder which can be a separated or an integral part of the press are mounted on the press which ensures the movements of the forces necessary for the compaction.

Figure 2A:
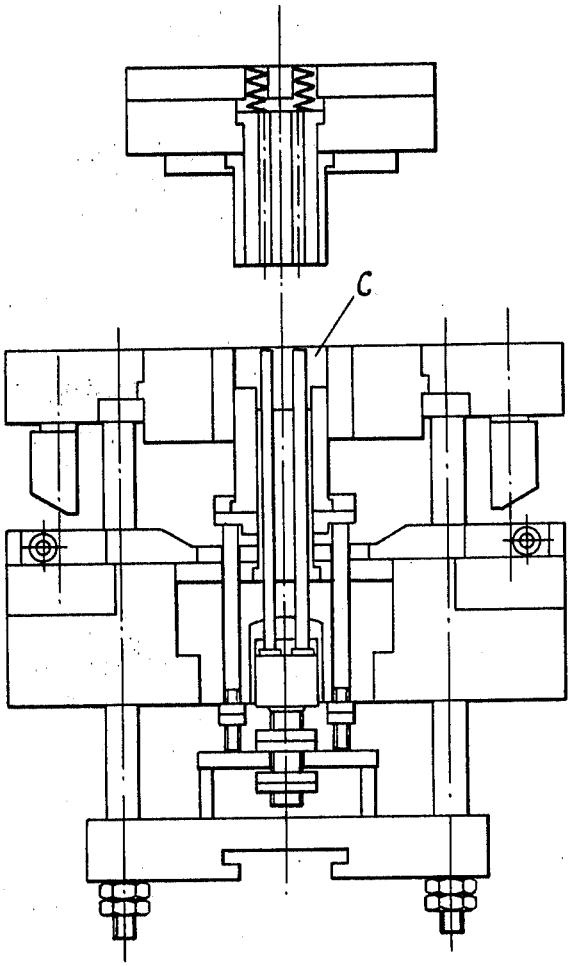
FIGS. 2A, 2B and 2C illustrate schematically the die of FIG. 1 in the filling position, end of compression and extraction of the formed piece.
Figure 2B:
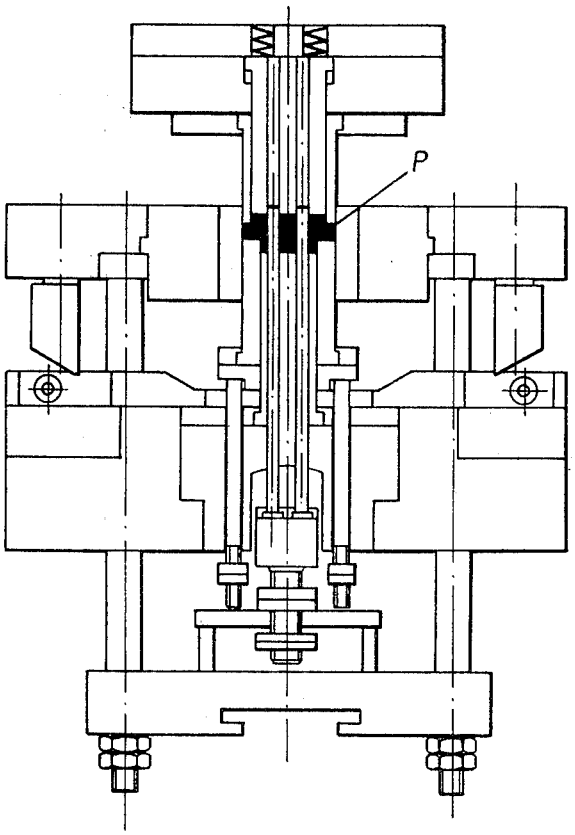
Figure 2C:
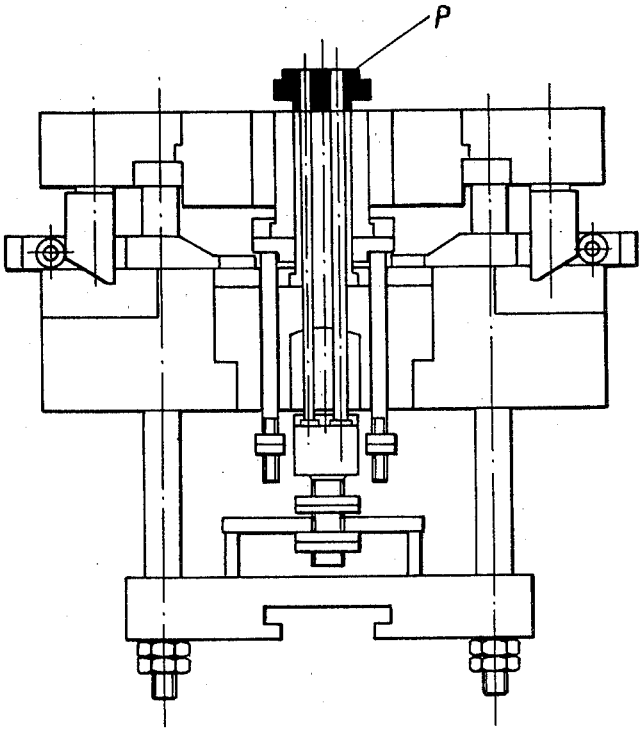

The functions that the die and press ensemble normally ensures are essentially three, that is:

(a) definition of a filling position (FIG. 2A) with the cavity C ready to receive the powder charge;

(b) definition of an end of compression position (FIG. 2B), wherein the formation of piece P is attained;

(c) definition of an end position of extraction from the cavity of thedie of the formed piece P (FIG. 2C).

As already said in the preamble, with the current presses there are limitations in the conformation of details which can be produced.

Figure 3C:
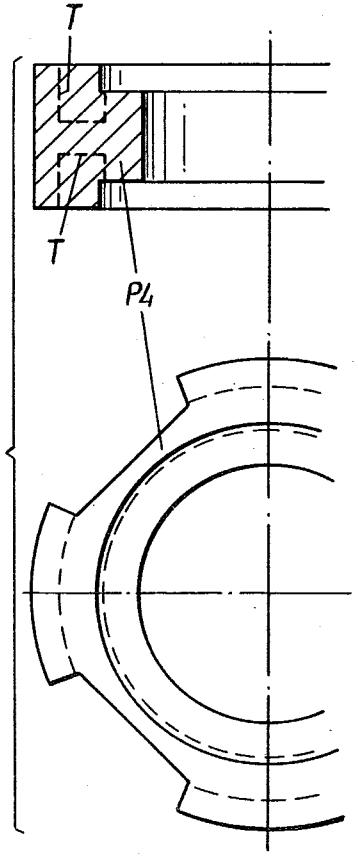
FIGS. 3A, 3B and 3C show the production steps of a piece to be produced by the conventional technique of the powder metallurgy and with subsequent mechanical finishing step.
Figure 3B:
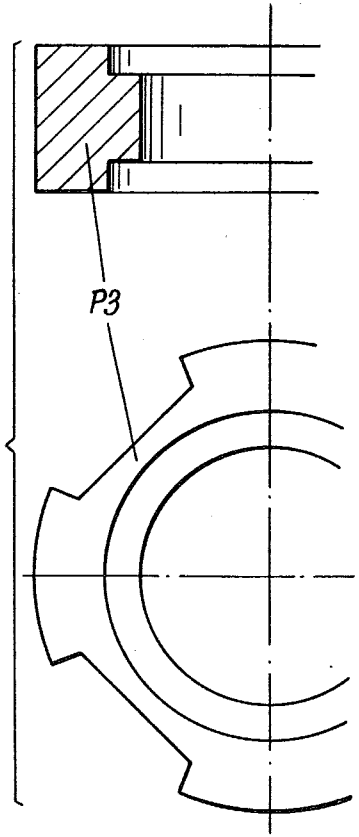
Figure 3A:
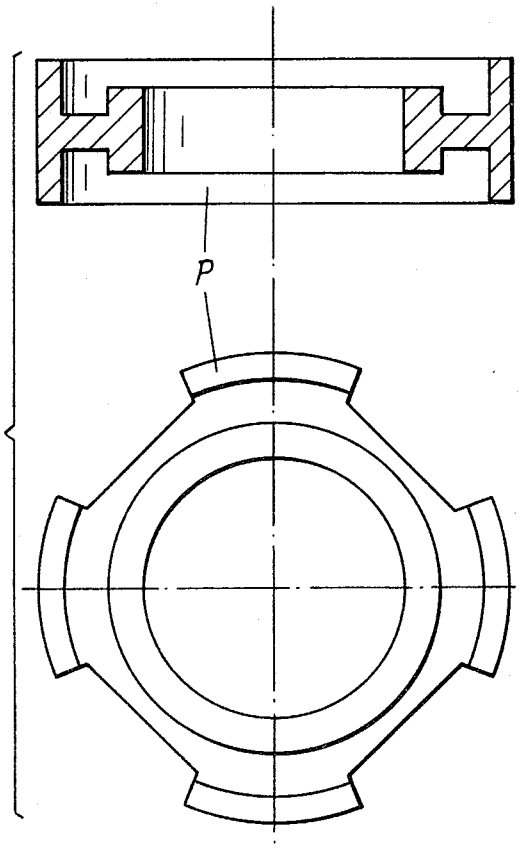

An example of what has been said is described in FIG. 3A wherein detail P indicates the design of the piece to be produced, detail P3 of FIG. 3B indicates the design of the rough-shaped piece which normally is currently produced, detail P4 of FIG. 3C indicates, in the hatched areas T, the material to be taken away by conventional mechanical work, in order to get a piece P.

Figure 4B:
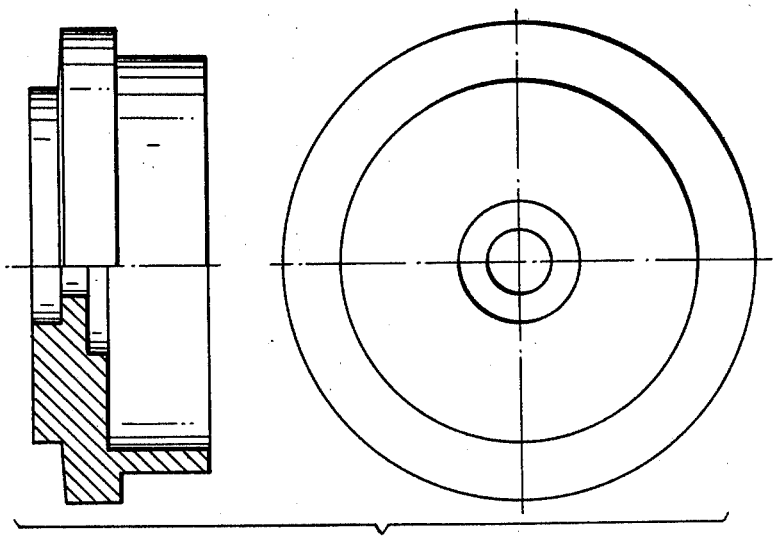
FIGS. 4A and 4B represent respectively an example of a convex shaped piece and of a concave shaped piece.
Figure 4A:
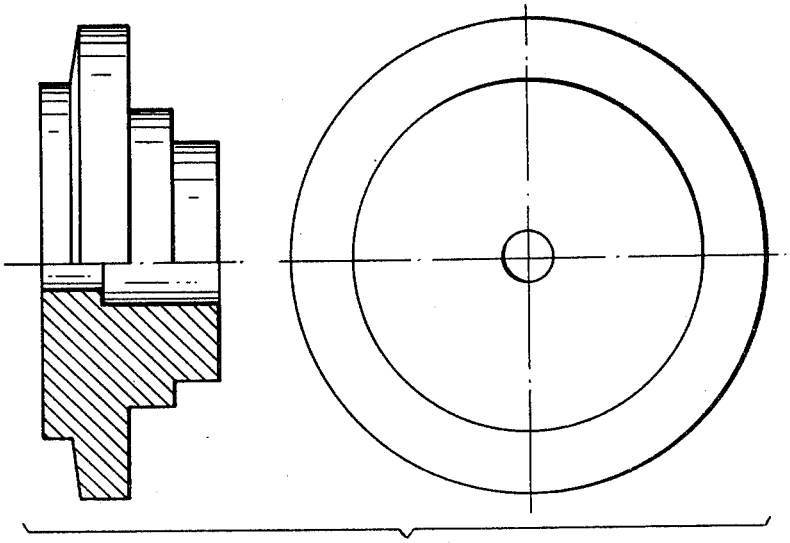

Besides, it should be observed that if a subsequent detail of a different shape has to be produced to-day, one is compelled to modify radically the assemblage type of die or to even change the press type, with a notable time loss for the equipment and with partial utilization of the plants. That is what happens, for example, when from the production of a detail of an essentially convex shape (FIG. 4A) one passes to the production of a detail of an essentially concave shape (FIG. 4B).

Figure 5:
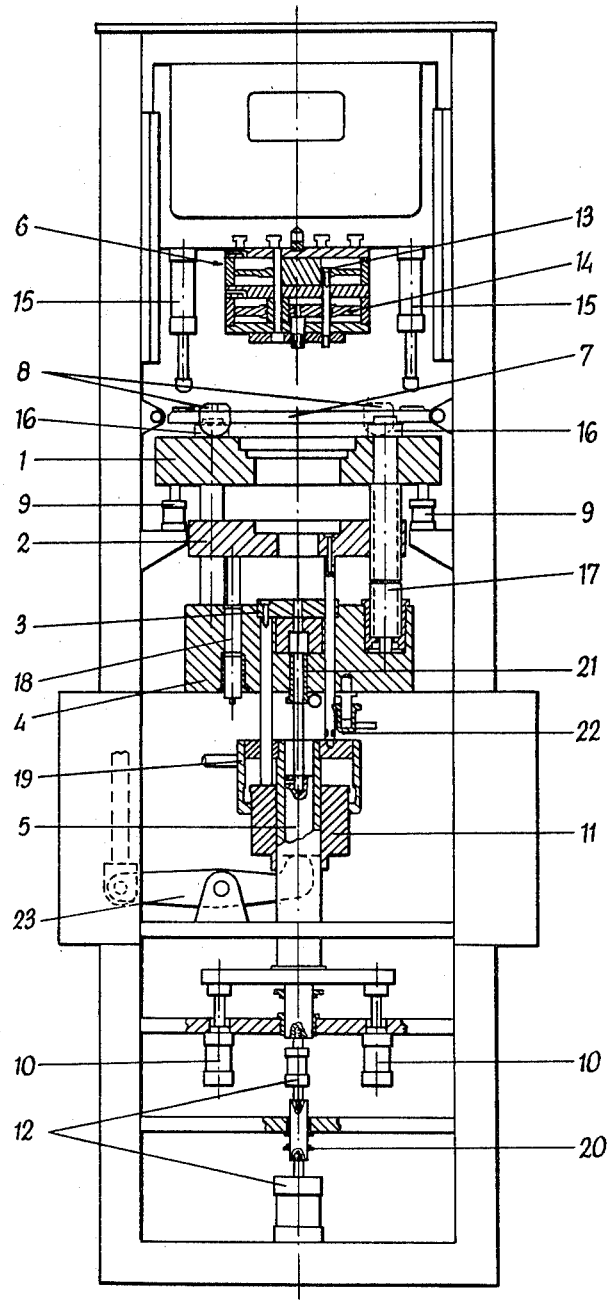
FIG. 5 shows a front elevation, partially in section, of a press according to the present invention

Referring to FIG. 5 it can be seen that the latter illustrates a die holder according to the present invention. The press includes a press frame 40 within which a support 41 for upper punches UP1 and UP2 is fastened to the frame 40. The upper punches are included in an upper punch holder 6 fastened to the support 41.

The displacement of the upper punches is controlled by double action cylinders 13, 14 provided within said holder 6. Within the press frame 40 it is provided a stationary table 4 having vertical rigid rods 30 upwardly projecting therefrom. In FIG. 5 reference numeral 1 is the matrix holder plate; 2 and 3 are the lower punch holder plates; 4 is the table, fixed with respect to the press structure; 5 is the core holder rod; 6 is the upper punch holder system; levers 7 with sliders 8 constitute the mechanical-hydraulic device for the controlled displacement of the matrix holder plate; 9 are the double acting cylinders whereto the lower punch holder plate 1 is interlocked; 10 are the cylinders whereto lower punch holder plate 2 is interlocked; 11 is the extraction movement control whereto lower punch holder plate 3 is interlocked, 12 are the double acting cylinders whereto core holder rod 5 is interlocked; 13 and 14 are the double acting cylinders whereto upper punch holder 6 is interlocked; 15 are the cylinders whereto the mechanical-hydraulic device for the controlled displacement of the matrix holder plate 1 is interlocked; and 23 is the control lever of the extraction movement.

The matrix holder plate is slidably arranged and supported by double action cylinders 9 fastened to the frame 40 and controlling the displacement of plate 1 which displacement is limited by lower stops 17 provided on the table 4 and upper stops 16 arranged on the plate 1.

Above the plate 1 there are arranged two levers 7, each having its one end pivoted to the frame 40 and its other end freely abutting on upper stops 16 by means of sliders 8 slidably arranged on the levers 7. The levers 7 and sliders 8 form together with the hydraulic cylinders 9 a mechanical-hydraulic device for controlling the displacement of the die holder plate 1, which has a central opening for carrying a die 32.

Beneath the plate 1 a first punch holder plate 2 supporting a first lower punch LP1 and a second punch holder plate 3 supporting a second lower punch LP2 are arranged, said first plate 2 being slidable on the rods 30 whereas said second plate 3 has its seat on the table 4.

The plates 2 and 3 carrying the lower punches LP1 and LP2 are controlled by hydraylic cylinders 10 fastened to the frame 40, said punches being concentrically arranged to one another.

Figure 6A:
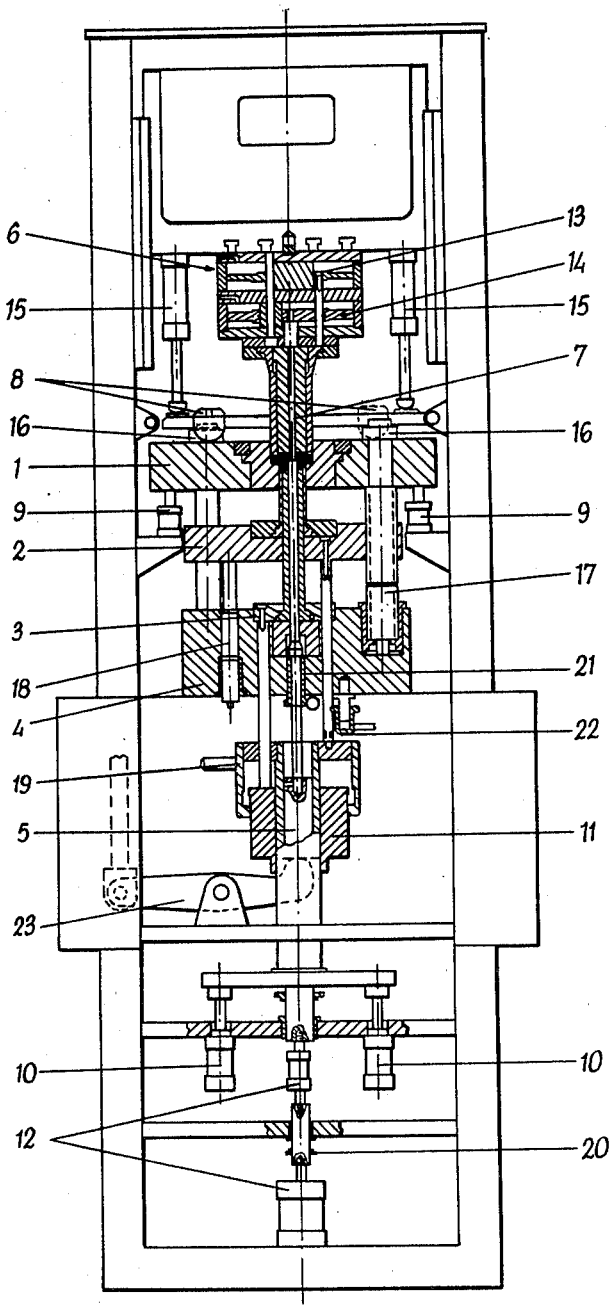
FIGS. 6A and 6B show the press of FIG. 5 with die and punch arrangements for manufacturing a convex piece and respectively a concave piece.
Figure 6B:
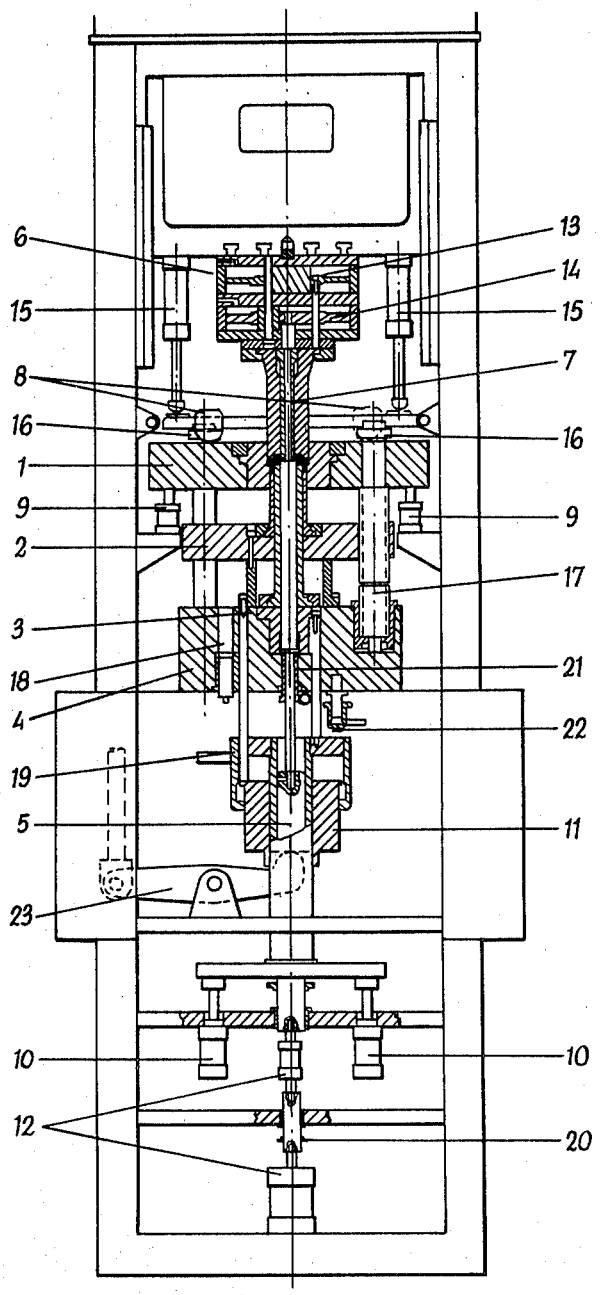

An extraction lever 23 is operatively connected to the plate 3 for removing the finished piece from the die plate 1 through the upward movement of the lower punch by means of an annular element 11 slidably arranged on a tubular element 35 on which the cylinders 10 act through a plate 36 for displacing the first lower punch LP1, as it may be seen in FIGS. 6A and 6B.

In the illustrated example cylinders 9 are double acting with adjustable pressures on the two actions. The reaction against the descending movement of the matrix holder plate 1 is adjustable by means of a maximum pressure valve; the maximum value of such a reaction will be held within the interval ranging from 0 to 0.1 P, if P is the nominal capacity of the press expressed in tons.

The force for the return back to an upper position of said plate is also adjustable, for example, by means of a pressure regulator; the maximum value of said force will be comprised in the interval ranging from 0 to 0.05 P.

Cylinders 10 are also double acting. One action is of reaction to the descent of the lower punch holder plate interlocked with said lower punches, adjustable by means of a maximum pressure valve; the maximum value of such a reaction will be in the interval 0+0.1 P wherein, as usual, P indicates the nominal capacity of the press in tons.

The force exercised by the cylinders to bring back to the upper position the lower punch holder plate will also be adjustable. The maximum value of such a force will be in the interval 0+0.05 P.

The press should foresee a hydraulic or pneumatic interlocking system like the one herein described for each lower punch holder plate, besides the first one.

Having been foreseen only two lower punch holder plates in the illustrated example (2 and 3) a single hydraulic interlocking system of said plates (10) has been envisaged.

Double acting cylinders 12 allow the core holder to descent against an adjustable raction; the maximum value of such a reaction will be in the interval 0+0.3 P. The force to return to the upper position will also be adjustable; the maximum value of such a force will be in the interval 0+0.03 P.

Double acting cylinders 13 and 14 have the function to check and/or control the movement of the upper punches. The active force in both actions will be adjustable; its maximum value will be adjustable; its maximum value will be in the interval 0+0.05 P.

Within the tubular element 35 it is placed a rod 5 bearing a core 33 extending through the lower punches, die, and upper punches. The core holder rod 5 is controlled by double action cylinders 12 acting on the lower end thereof.

The cylinders 12 exert an adjustable reaction against the downward movment of the core holder rod 5, the maximum value of which ranges from 0 to 0.3 P, likely as the maximum value of the force for returning the rod 5 to its upper position.

The displacement of the lower punches is limited by an upper stop element 19 provided beneath the table 4 and by a lower stop element 18 provided within the table 4.

The displacement of the core holder rod 5 is limited by an upper stop element 20 rigidly arranged at the lower end of said rod and by a lower stop element 21 provided at a central bore of the table 4. Finally a stop element 22 is provided for limiting the upward displacement of the first lower punch LP1.

It will be possible also to have a passive reaction adjustable by means of a maximum pressure valve: the maximum value of such reaction will be in the range 0+0.1 P. In the illustrated example, interlocking of two upper punches has been envisaged, each to one of the cylinders 13 and 14, independent of each other and conforming to the previous description.

It is possible to foresee a smaller or greater number of such cylinders.

Cylinders 15 have the function of regulating the operation of the thrusting system of the matrix holder plate 1. The displacement of sliders 8 on levers 7 allows for variation in the interval 0+1 of the ratio between the descending speed of the matrix and the descending speed of the press head. The thrust on such a system is exercised through cylinders 15 which may transmit a force which can be adjusted by means of a maximum pressure valve, and the maximum value of such a force will range in the interval 0+0.1 P. In any event it will be possible to annul this force at any point of the descending stroke of the matrix holder plate. This system of control, thus described, may be substituted by any other system which gives like performances.

The aforementioned stops 16 are the upper stops of matrix holder plate 1, and 17 are the lower stops of said plate. 18 is the lower stop of the lower punch holder plate 2; 19 is the upper stop of said plate, 20 is the upper stop of core holder 5, 21 is the stop of the end of compression of said core holder, 22 is the stop of the end of extraction of punch holder plate 2. All these stops allow for a rapid assemblage and a more rational utilization of the die.

It is possible, therefore, by means of the utilization of the finding described:

(a) to control and adjust the movement of the elements constituting the die during the phase of compression by adjusting the reactions of cylinders 9, 10, 12, 13, 14, 15 whereto these elements are interlocked;

(b) to control and adjust the movement of the elements constituting the die during the extraction phase by adjusting cylinders 9, 10, 12, 13, 14, whereto these elements are interlocked;

(c) to control and adjust the movement of the elements constituting the die during the returning phase to the filling position by adjusting the active forces of the same double acting cylinders 9, 10, 12, 13, 14 whereto these elements are interlocked;

(d) to produce all the forms and the dimensions theoretically realizable with the metallurgy of the powder technology, with the single limitation of the press nominal capacity, being the active and the passive forces of cylinders 9, 10, 12, 13, 14, 15 and of system 11 comprised in the previously described fields.

(e) to produce with the same press, indifferently, details of form essentially convex or essentially concave, without radical and expensive modifications, being sufficient for example, to reverse the functions of plates 2 and 3 as shown in FIG. 6A, wherein an example of assemblage for detail of essentially convex form is illustrated and in FIG. 6B wherein an example of assemblage for detail of essentially concave form is illustrated;

(f) to reduce the assemblage and mounting times by utilizing all the adjustable stops in the press and in the die holder, with the help of eventual position indicators on the press control board.

The present invention has been described with particular reference to a specific embodiment thereof, but it must be understood that constructional variations could be introduced in practice thereto without departing from the protection limit of the present industrial patent.

Having thus described the present invention, what is claimed is:

1. In a press for compressing pulverulent materials into concave-shaped or convex-shaped articles including a press frame, a die carrying plate, a plurality of upper and lower punches, support means for carrying the upper and lower punches and control means for controlling the displacement of the upper and lower punches, a combination comprising: first piston-cylinder means for controlling the displacement of said die carrying plate; second piston-cylinder means fastened to said frame and supporting said die plate; lever means arranged above said die carrying plate and having one end portion pivoted to said frame and an opposite other end portion; slider means slidable on said opposite end portion and abutting on said die carrying plate, said first piston-cylinder means acting on said other end portion of said lever means to exert thereon a pressure depending on the distance of said slider means from said other end portion of said lever means; first support means for each of said lower punches; third piston-cylinder means fastened to said frame for controlling said first support means; adjustable stop elements for limiting the displacemen range of said die carrying plate and said first supporting means; second support means for supporting the upper punches control means provided within said second supports means and operative for controlling the displacement of the upper punches, said upper and lower punches being concentrically arranged relative to each other; a movable core arranged within said upper and lower punches; a core rod supporting said core; third support means for said core rod, fourth piston-cylinder means for controlling the displacement of said third support means and having a lower end connected to said core rod; and adjustable stop elements for limiting the displacement range of said core rod.

2. The combination as claimed in claim 1, wherein said first, second and third piston-cylinder means are actuated by a fluid medium and are provided with control valves for adjusting their reaction in both the downstroke and upstroke thereof.

3. In a press for compressing pulverulent materials into concave-shaped or convex-shaped articles, the combination comprising a press frame; an upper punch holder unit fastened to the press frame for supporting concentrical upper punches and including control means for controlling the displacement of said upper punches; a table fastened to said frame; a plurality of vertical stationary rods upwardly projecting from said table; a matrix plate having a central aperture for a matrix and slidably arranged on said vertical rods, said rods each having a upper stop and a lower stop for determining the displacement range of said matrix plate; piston-cylinder means fastened to said frame for supporting said matrix plate, lever means having one end portion pivoted to said frame above said matrix plate and an opposite other end portion; slider means slidably arranged on said lever means at said opposite end portion and abutting on said matrix plate, piston-cylinder means acting on said other end portion to displace said matrix plate through said slider means; a first lower punch holder plate slidably arranged on said vertical rods beneath said matrix plate and having a central aperture; a first lower punch adapted to be fastened at its one end within said aperture of said lower punch plate and projecting into the central aperture of said matrix plate; control means for controlling the movement of said first lower punch holder plate; a second lower punch holder plate arranged within a central aperture of said table; a second lower punch supported by said second plate and arranged within said control means for controlling the movement of said first lower punch plate; a core passing through said lower and upper punches; a core rod carrying said core at the lower end thereof; support means for holding said core rod; extracting lever means operatively connected to one of said lower punches for removing an article formed by said punches and core; piston-cylinder means for controlling the displacement of said core rod support means, and stop elements operative for limiting the displacement of all said support means of said punches and core rod, respectively.

4. The combination of claim 3, wherein said piston cylinder means are actuated by a fluid medium and are provided with control valves for adjusting their reaction in both the downstroke and upstroke thereof.

* * * * *